US006761384B1

(12) United States Patent
Haaf et al.

(10) Patent No.: US 6,761,384 B1
(45) Date of Patent: Jul. 13, 2004

(54) DEVICE FOR OPENING A TRUNK OF A MOTOR VEHICLE

(75) Inventors: Jürgen Haaf, Beindersheim (DE); Dieter Trumpfheller, Reichelsheim (DE)

(73) Assignee: DaimlerChrysler AG, Stuttgart (DE)

( * ) Notice: Subject to any disclaimer, the term of this patent is extended or adjusted under 35 U.S.C. 154(b) by 393 days.

(21) Appl. No.: 09/589,016

(22) Filed: Jun. 7, 2000

(30) Foreign Application Priority Data

Jun. 15, 1999 (DE) ..... 199 27 179

(51) Int. Cl.[7] ..... E05B 65/19

(52) U.S. Cl. ..... 292/336.3; 292/DIG. 43; 292/DIG. 65; 296/76; 340/426.29; 340/426.36

(58) Field of Search ..... 292/336.3, DIG. 14, 292/DIG. 23, DIG. 42, DIG. 43, DIG. 65, 216, 201; 296/76; 340/426, 825.72, 425.5, 545.3, 545.5, 522, 573; 70/256, 262–264, 275; 307/10.1, 10.8; 359/142; 341/176

(56) References Cited

U.S. PATENT DOCUMENTS

| | | | | |
|---|---|---|---|---|
| 3,992,909 A | | 11/1976 | McGhee | |
| 4,080,812 A | | 3/1978 | Knott | |
| 5,445,326 A | | 8/1995 | Ferro et al. | |
| 5,693,987 A | * | 12/1997 | Krucoff | 307/10.2 |
| 5,723,911 A | * | 3/1998 | Glehr | 307/10.2 |
| 5,736,793 A | * | 4/1998 | Jahrsetz et al. | 307/10.1 |
| 5,859,479 A | | 1/1999 | David | 307/10.8 |
| 5,952,732 A | * | 9/1999 | Scarpitti | 307/10.3 |
| 6,018,292 A | * | 1/2000 | Penny et al. | 340/426 |
| 6,086,131 A | * | 7/2000 | Bingle et al. | 296/76 |
| 6,130,614 A | * | 10/2000 | Miller et al. | 340/573.4 |
| 6,209,933 B1 | * | 4/2001 | Ang et al. | 292/336.2 |
| 6,222,442 B1 | * | 4/2001 | Gager et al. | 340/426 |

FOREIGN PATENT DOCUMENTS

| | | |
|---|---|---|
| FR | 695009 | 8/2002 |
| WO | WO 97/01010 | 1/1997 |

* cited by examiner

*Primary Examiner*—Anne Marie Boehler
(74) *Attorney, Agent, or Firm*—Crowell & Moring LLP

(57) ABSTRACT

The present invention relates to a device for opening a lid of a trunk of a motor vehicle, there being mounted in the trunk an actuating element whose actuation results in the lid of the trunk being unlocked, if appropriate, and the lid being opened, the motor vehicle furthermore having a remotely operable closing system, and when the actuating element is actuated, the actuating element emits beams which correspond to the beams of the remotely operable closing system in such a manner that the lid is unlocked, if appropriate, and opened.

5 Claims, 1 Drawing Sheet

DEVICE FOR OPENING A TRUNK OF A MOTOR VEHICLE

BACKGROUND OF THE INVENTION

The invention relates to a device for opening a lid of a trunk of a motor vehicle, there being mounted in the trunk an actuating element whose actuation results in the lid of the trunk being unlocked, if appropriate, and the lid being opened.

U.S. Pat. No. 5,445,326 discloses a device in which the trunk of a motor vehicle can be opened from the inside. For this purpose, there is an actuating element which may be designed as a push-button switch and may be provided with a luminescent surface. This actuating element is mounted directly on the lock of the trunk lid and acts mechanically on the lock of the trunk lid. Correspondingly, actuating elements for opening trunk lids from the trunk are furthermore known, the said actuating elements acting mechanically on the lock of the trunk lid. U.S. Pat. No. 4,115,233, U.S. Pat. No. 3,992,999 and U.S. Pat. No. 4,080,812 may be mentioned in this regard.

The opening of the trunk lid from the inside is intended to make it possible for a person who has entered the trunk to be able to open the trunk again from the inside.

SUMMARY OF THE INVENTION

The present invention is based on the object of improving the device for opening a trunk.

According to the invention, this object is achieved by the fact that the motor vehicle has a remotely operable closing system, and that when the actuating element is actuated, the actuating element emits beams which corresponds to the beams of the remotely operable closing system in such a manner that the lid is unlocked, if appropriate, and opened.

DETAILED DESCRIPTION OF THE PREFERRED EMBODIMENTS

This advantageously achieves greater flexibility in the location for mounting the actuating element. In the case of the known mechanical actuating elements it was necessary, for structural reasons, to mount the said actuating elements on the lock itself. The lock is situated in the center of the vehicle. If a person has been shut into the trunk, it may not be possible, because of his situation and position, for him to get to the actuating element in order to open the trunk. With the present invention, the location for mounting it can be selected flexibly to a great extent. Since the actuating element interacts with a remotely operable closing system which is quite conventional these days, the additional structural outlay can advantageously be kept within tight limits.

It is possible, in particular, to mount the actuating element laterally on a wall of the trunk, since—if a person is in the trunk—for space reasons he will be predominantly lying in the transverse direction. Reference should be made here to the refinement according to claim 5 with which it is then, for example, possible to mount an actuating element on each side of the vehicle.

Figure 2:
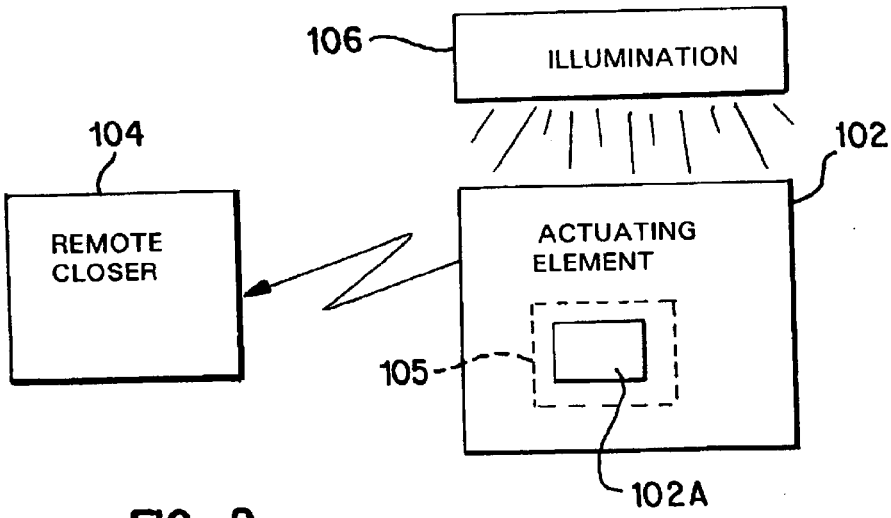
FIG. 2 is a schematic block diagram that illustrates the remote closer and actuating element of FIG. 1.

In the case of the refinement of the device according to claim 2, the actuating element is a push-button switch or a pressure-operated switch (illustrated schematically as block 102A in FIG. 2).

In this case, it has proven advantageous that an actuating element of this type can be operated in a simple manner, this being of particular advantage in the comparatively confined space conditions in the trunk of a motor vehicle.

In the refinement of the device according to claim 3, the actuating element is illuminated at least for a certain period of time after the lid of the trunk is closed and/or locked.

This can, for example, be realized by the surface of the actuating element being of luminescent design.

There may also be an illuminating means which is connected to the voltage of the electric system of the motor vehicle. Its switch-on duration is advantageously restricted in order to avoid, if possible, running down the battery when the vehicle is at a standstill for a prolonged period.

Because of the illumination, the actuating element can be found in a simple manner with the lid of the trunk closed.

In the refinement of the device according to claim 4, the actuation element 102 is provided with a cover 105 (FIG. 2).

It can thereby advantageously be avoided that items of luggage which are not secured and move around in the trunk while underway lead to the actuating element being triggered, so that the trunk is opened unintentionally. This cover is advantageously transparent, so that illumination of the actuating element can advantageously be seen, as before. The cover can be opened in a simple manner, for example by means of a flap mechanism.

In the case of the device according to claim 5, there are a plurality of actuating elements.

An actuating element 102 can, for example, advantageously be mounted on each side of the vehicle, so that irrespective of the direction in which the person in the trunk lies, an actuating element can always be reached.

Figure 1:
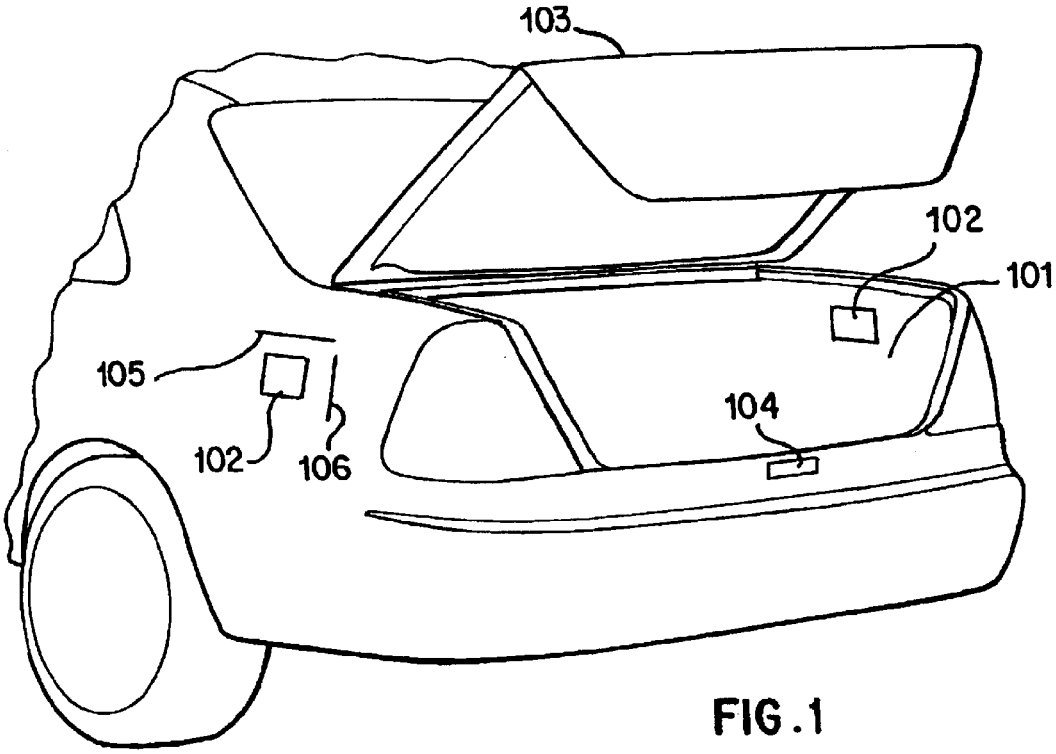
FIG. 1 is a schematic perspective view which shows the components of the opening device according to the invention.

An exemplary embodiment of the invention is illustrated in FIGS. 1 and 2 of the drawing. The figures show a motor vehicle which, in the exemplary embodiment shown, is a notchback sedan. This motor vehicle has a trunk 101. An actuating element 102, which may comprise a push button or pressure actuated switch 102A, is mounted on each of the side walls of this trunk. Actuation of one of these actuating elements 102 causes the lid 103 of the trunk 101 to be unlocked, if appropriate, and opened. For this purpose, the particular actuating element 102, after it is actuated, emits radiation which corresponds to the radiation of a remotely operable closing system 104 of the motor vehicle. This may, for example, be infrared radiation. The actuating elements 102 may be illuminated 106 and/or may have a cover 105.

What is claimed is:

1. A device for opening a lid of a trunk of a motor vehicle comprising:

an actuating element operatively arranged in the trunk and capable of emitting a beam when actuated, and a remotely operable closing system operatively arranged on the motor vehicle and operable to lock and unlock the lid, the remotely operable closing system being capable of receiving a beam corresponding to the beam emitted from the actuating element and unlocking the lid, wherein, when the actuating element is actuated, the beam is emitted therefrom and received by the remotely operable closing system which unlocks the lid.

2. The device according to claim 1, wherein the actuating element is a push-button switch or pressure-operated switch.

3. The device according to claim 1, wherein the actuating element is illuminated at least for a certain period of time after the lid of the trunk is closed.

4. The device according to claim 1, wherein the actuating element is provided with a cover.

5. The device according to claim 1, wherein there is a plurality of actuating elements.

* * * * *